US007680431B2

(12) United States Patent
Ikebata

(10) Patent No.: US 7,680,431 B2
(45) Date of Patent: Mar. 16, 2010

(54) IMAGE READING APPARATUS AND IMAGE COMPOSITE APPARATUS HAVING A DOCUMENT READER OPENABLY AND CLOSABLY ATTACHED TO AN UPPER PART OF THE APPARATUS

(75) Inventor: Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 547 days.

(21) Appl. No.: 11/698,429

(22) Filed: Jan. 26, 2007

(65) Prior Publication Data

US 2007/0177892 A1 Aug. 2, 2007

(30) Foreign Application Priority Data

Jan. 27, 2006 (JP) ..... 2006-019759

(51) Int. Cl.
*G03G 15/00* (2006.01)

(52) U.S. Cl. ..... 399/107; 399/110; 399/125

(58) Field of Classification Search ..... 399/107, 399/110, 125, 111, 119
See application file for complete search history.

(56) References Cited

U.S. PATENT DOCUMENTS 7,133,626 B2 11/2006 Kaiga et al.
7,440,712 B2 * 10/2008 Uchida ..... 399/107
7,447,466 B2 * 11/2008 Ikebata ..... 399/110
7,561,825 B2 * 7/2009 Hirose et al. ..... 399/110

FOREIGN PATENT DOCUMENTS

JP 2005-62326 3/2005

* cited by examiner

*Primary Examiner*—William J Royer
(74) *Attorney, Agent, or Firm*—Gerald E. Hespos; Anthony J. Casella

(57) ABSTRACT

An image forming apparatus has a main body for performing image forming operations. A document reader is above the main body and can displace between closing and opening postures. A coupling has a first end rotatably coupled to the main body and a second end coupled to the document reader for movement between a first posture to support the document reader in the opening posture and a second posture when the document reader is closed. A guiding surface at the document reader guides movement of the second end of the coupling. A stopper is supported for rotation between an interfering posture to interfere with the second end of the coupling and a freeing posture to free the second end. The second end is pushed into an escaping recess of the guiding surface by the stopper when the stopper is displaced from the interfering posture to the freeing posture.

9 Claims, 7 Drawing Sheets

311
832
83
80
70
40
60
50
30
74
62
71
S6
61
52
72
73
R
75

311
832
83
80
70
40
60
50
30
74
62
71
S5
61
52
72
73
R
75

+X
-Y
+Y
-X

+X
-Y
+Y
-X
S1
S2
100
101
102
103
104
104a
104b
105
106
106a
106b
107

IMAGE READING APPARATUS AND IMAGE COMPOSITE APPARATUS HAVING A DOCUMENT READER OPENABLY AND CLOSABLY ATTACHED TO AN UPPER PART OF THE APPARATUS

BACKGROUND OF THE INVENTION

1. Field of the Invention

The present invention relates to an image forming apparatus having a document reader openably and closably attached relative to an upper surface of an apparatus main body or a composite apparatus formed by combining two apparatuses.

2. Description of the Related Art

An image forming apparatus 100 as shown in FIGS. 7A to 7C has been conventionally known. It should be noted that, in FIGS. 7A to 7C, only essential parts as prior art to be compared with the present invention are shown by omitting unnecessary members in order to facilitate the description. Further, in FIGS. 7A to 7C, X-X directions and Y-Y directions are referred to as transverse directions and forward and backward directions, respectively, wherein −X direction is leftward direction, +X direction rightward direction, −Y direction forward direction and +Y direction backward direction.

This image forming apparatus 100 is provided with a box-shaped apparatus main body 101 in which various devices for image formation such as a photoconductive drum and a developing device are mounted, and a document reader 102 attached displaceably relative to an opening in an upper surface of the apparatus main body 101 between a closing posture S1 (see FIG. 7A) and an opening posture S2 (see FIG. 7B) by rotating about a transversely extending supporting shaft 103.

The document reader 102 is a heavy article internally provided with an unillustrated contact glass which a document surface faces, an unillustrated light source for emitting a light to the document surface, a plurality of unillustrated mirrors for introducing a reflected light from the document surface to a CCD, and an unillustrated moving mechanism for moving the light source and the mirrors. Such a document reader 102 is made openable and closable so that the interior of the apparatus main body 101 can be inspected by opening the document reader 102 and unillustrated developing devices are detached and attached for replacement.

A pair of left and right coupling arms 104 are disposed between the apparatus main body 101 and the document reader 102. A bottom end portion of each coupling arm 104 is supported rotatably about a transversely extending supporting shaft 104*a*, whereas an upper end portion 104*b* thereof is movable along a corresponding guiding groove 105 formed in a bottom surface of the document reader 102 while being so guided as not to come out. Accordingly, the respective coupling arms 104 turn about the supporting shafts 104*a* and the upper end portions 104*b* thereof are moved back and forth along the corresponding guiding grooves 105 by opening and closing the document reader 102.

A pair of left and right stoppers 106 are provided to keep the document reader 102 in the opening posture S2. When the upper end portions 104*b* of the coupling arms 104 are moved from the front end portions of the guiding grooves 105 and passed the stoppers 106 to set the document reader 102 in the opening posture S2, their upper end portions 104*b* are stopped by these stoppers 106 as shown in FIG. 7B. The coupling arms 104 are prevented from turning in clockwise direction about the supporting shafts 104*a* by the stoppers 106, whereby the document reader 102 can be kept in the opening posture S2.

The stoppers 106 are supported rotatably about vertical shafts 106*a* provided at specified positions inward of the coupling arms 104 on the bottom surface of the document reader 102. When the coupling arms 104 pass the stoppers 106 to set the document reader 102 in the opening posture S2, the stoppers 106 come to rest on protuberances 106*b* projecting from the bottom surface of the document reader 102 to be stopped. Accordingly, the stoppers 106 do not rotate even if the upper end portions 104*b* of the coupling arms 104 push the stoppers 106 forward. Thus, the document reader 102 can be kept in the opening posture S2.

An operating lever 107 for rotating such stoppers 106 toward the corresponding coupling arms 104 about the vertical shafts 106*a* is provided at the front side of the document reader 102. If this operating lever 107 is operated, for example, to right, the outer ends of the respective stoppers 106 are rotated toward the coupling arms 104 about the vertical shafts 106*a*. Then, the stoppers 106 are moved to such positions (retracted positions) as not to be interfered with by the coupling arms 104 after temporarily pushing the coupling arms 104 backward as shown in FIG. 7C.

The pair of coupling arms 104 are made rotatable in clockwise direction about the supporting shafts 104*a* by operating the operating lever 107 to move the stoppers 106 to the retracted positions. Thus, the document reader 102 can be displaced from the opening posture S2 to the closing posture S1 shown in FIG. 7A.

Japanese Unexamined Patent Publication No. 2005-62326 discloses an image forming apparatus provided with an apparatus main body constructed to enable an image forming operation, and a document reader attached openably and closably relative to the apparatus main body. However, this publication discloses nothing corresponding to the above stoppers.

In the image forming apparatus 100 shown in FIGS. 7A to 7C, upon returning the document reader 102 set in the opening posture S2 to the closing posture S1, the stoppers 106 have to be rotated in clockwise and counterclockwise directions about the vertical shafts 106*a* by operating the operating lever 107, the oblique coupling arms 104 have to be pushed in a direction toward their upright positions, and the document reader 102 has to be temporarily lifted up via the coupling arms 104.

However, it is quite difficult to lift the heavy document reader 102 only by operating the operating lever 107. Accordingly, upon closing the document reader 102, a user has been performing a cumbersome operation of moving the operating lever 107 by one hand while lifting a front end of the document reader 102 by the other hand.

SUMMARY OF THE INVENTION

An object of the present invention is to provide an image forming apparatus having improved operability in closing a document reader by enabling the document reader to be easily closed without performing any such cumbersome operation of temporarily lifting the document reader.

In order to accomplish this object, the present invention is directed to an image forming apparatus, comprising an apparatus main body for performing an image forming operation; a document reader displaceable between a closing posture and an opening posture by rotating about a specified supporting shaft relative to an upper surface of the apparatus main body; a coupling arm having a first end and a second end located at a side opposite to the first end, the first end being rotatably coupled to the apparatus main body and the second end being movably coupled to the document reader, and displaceable between a first posture to support the document reader in the opening posture in a standing state and a second posture taken when the document reader is in the closing posture and closer to a horizontal posture than the standing posture; a guiding member provided at the document reader and having a guiding surface for guiding a movement of the second end of the coupling arm; and a stopper supported rotatably about a specified shaft so as to be displaceable between an interfering posture to interfere with the second end of the coupling arm and a freeing posture to free the second end from interference, wherein an escaping recess capable of accommodating the second end therein is formed in the guiding surface of the guiding member, and the second end is guided into the escaping recess by a pushing force given from the stopper to the second end when the stopper is displaced from the interfering posture to the freeing posture.

These and other objects, features, aspects and advantages of the present invention will become more apparent upon a reading of the following detailed description and accompanying drawings.

BRIEF DESCRIPTION OF THE DRAWINGS

FIGS. 1A to 1C are diagrams showing one embodiment of an image forming apparatus according to the invention, wherein FIG. 1A is a perspective view showing the external construction and FIGS. 1B and 1C are side views in section showing a state where a document reader is set in a closing posture and a state where the document reader is set in an opening posture, respectively.

FIGS. 2A and 2B are perspective views showing a state where the document reader is opened, wherein FIG. 2A shows this state when the opened document reader is viewed from front left side and FIG. 2B shows this state when the opened document reader is viewed from front right side.

FIGS. 3A and 3B are diagrams showing a locking construction shown in FIGS. 2A and 2B when viewed from below the document reader, wherein FIG. 3A shows a state where stoppers are set in an interfering posture and FIG. 3B shows a state where the stoppers are set in a freeing posture.

FIGS. 7A to 7C are perspective views conceptually showing a prior art image forming apparatus, wherein FIG. 7A shows a state where a document reader is set in a closing posture, FIG. 7B shows a state where the document reader is locked in an opening posture by stoppers and FIG. 7C shows a state where the stoppers are temporarily pushing coupling arms backward.

DETAILED DESCRIPTION OF THE PREFERRED EMBODIMENTS

Hereinafter, one embodiment of the present invention is described with reference to the accompanying drawings.

Figure 1A:
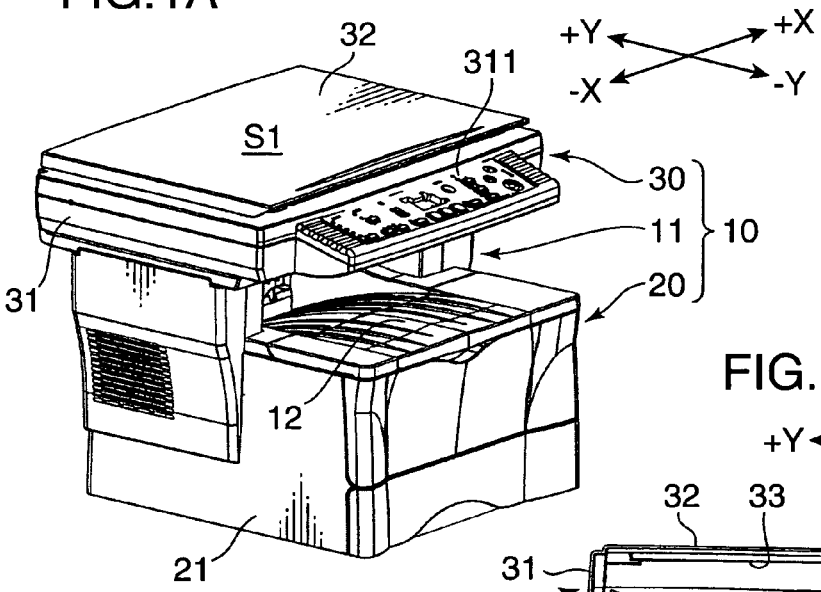
Figure 1B:
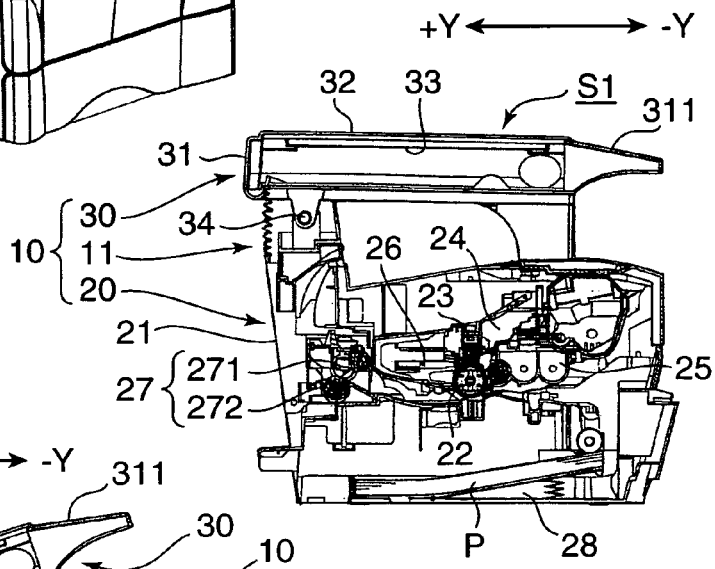
Figure 1C:
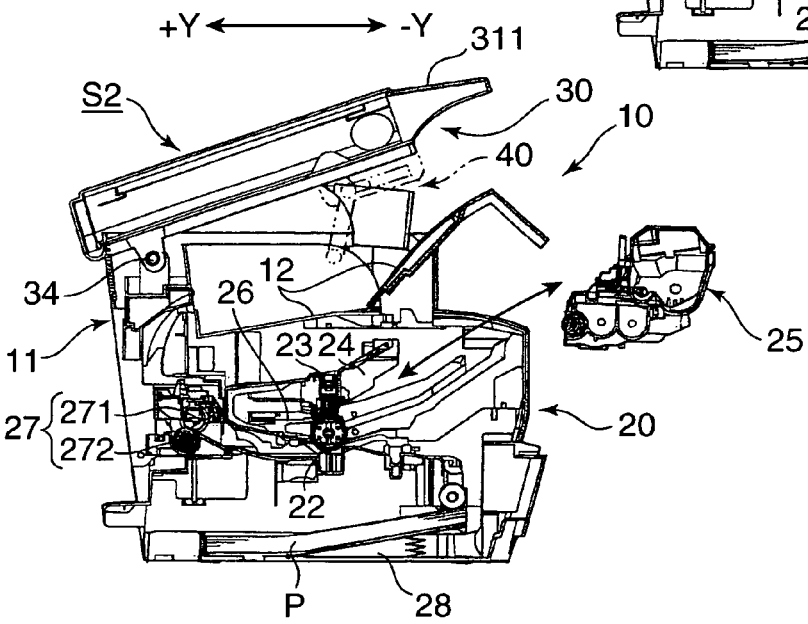

FIGS. 1A to 1C are diagrams showing an image forming apparatus 10 according to one embodiment of the invention, wherein FIG. 1A is a perspective view showing the external construction and FIGS. 1B and 1C are side views in section showing a state where a document reader 30 is set in a closing posture S1 and a state where the document reader 30 is set in an opening posture S2, respectively. It should be noted that, in FIGS. 1A to 1C, X-X directions and Y-Y directions are referred to as transverse directions and forward and backward directions, respectively, wherein −X direction is leftward direction, +X direction rightward direction, −Y direction forward direction and +Y direction backward direction.

As shown in FIG. 1A, the image forming apparatus 10 according to this embodiment is of a so-called internal discharge type. The image forming apparatus 10 is basically comprised of an apparatus main body 20 (first apparatus) having various devices and members for image formation mounted therein, and the document reader 30 (second apparatus) provided above this apparatus main body 20 via a coupling portion 11. A sheet discharge tray 12 to which a sheet P finished with an image fixing operation is discharged is formed atop the apparatus main body 20 between the apparatus main body 20 and the document reader 30. The coupling portion 11 stands at the rear side of the apparatus main body 20.

The apparatus main body 20 is constructed by mounting a photoconductive drum 22, a charging device 23, an exposing device 24, a developing device 25, a cleaning device 26, and a fixing device 27, etc. in a box-shaped lower external cover body 21 as shown in FIGS. 1A and 1B. A detachably attachable sheet cassette 28 is mounted at a bottom part of the lower external cover body 21. Upon an image forming operation, sheets P are fed one by one from this sheet cassette 28 to the apparatus main body 20, and images based on image information read by the document reader 30 are transferred to these sheets P.

The photoconductive drum 22 is disposed rotatably about its central axis and has an electrostatic latent image and a toner image formed on the outer circumferential surface thereof while being rotated. The toner image formed on the outer circumferential surface of the photoconductive drum 22 is transferred to the sheet P, thereby applying an image transferring operation to the sheet P.

The charging device 23 is for uniformly imparting electric charges to an outer circumferential surface of the photoconductive drum 22 rotating about its central axis. The exposing device 24 is for forming an electrostatic latent image by emitting a beam based on an image information of a document image read by the document reader 30 to the uniformly charged outer circumferential surface of the photoconductive drum 22. The developing device 25 is for forming a toner image by supplying toner to the electrostatic latent image formed on the outer circumferential surface of the photoconductive drum 22. The cleaning device 26 is for cleaning the outer circumferential surface of the photoconductive drum 22 by removing toner residual thereon after transfer of the toner image to the sheet P.

The fixing device 27 is for fixing the toner image on the sheet P transferred from the outer circumferential surface of the photoconductive drum 22, and includes a fixing roller 271 having a heating element inside and a pressure roller 272 whose outer circumferential surface is in contact with that of the fixing roller 271. The sheet P after the image transferring operation has the toner image fixed thereto by receiving heat from the fixing roller 271 while passing between the fixing roller 271 and the pressure roller 272.

The sheet P after the image fixing operation is moved upward through an inside of the coupling portion 11 to be discharged to the discharge tray 12 provided at a position before the coupling portion 11.

The document reader 30 is such that various members and devices used to read a document image are mounted in an upper external cover body 31 having a flat rectangular parallelepipedic shape. The members and devices mounted therein include, for example, a light source lamp, a reflecting mirror, a moving mechanism for moving the light source lamp and the reflecting mirror, and a CCD (charge-coupled device) image sensor on which a reflected light is incident via the reflecting mirror. An openable and closable document pressing cover 32 is provided on the upper surface of the document reader 30.

A contact glass 33 (see FIG. 1B) on which a document is to be placed is fitted in an opening formed in an upper surface of the upper external cover body 31. The document pressing cover 32 is made openable and closable by being rotated with a specified position of a rear edge thereof as a supporting point. The document pressing cover 32 presses a document placed on the contact glass 33 by being set in the closing posture.

An operation table 311 projecting outward is provided at a front part of the upper external cover body 31. An image forming operation in accordance with set conditions is performed by pressing specified one(s) of various operation keys arranged on the operation table 311.

In this embodiment, the developing device 25 filled with the toner particles is detachably mounted in the apparatus main body 20. When the toner particles run out, this developing device 25 is replaced by a new one.

For such replacement of the developing device 25, the front side of the discharge tray 12 is rotatable in counterclockwise direction about a specified horizontal axis to expose a front upper part of the lower external cover body 21 as shown in FIG. 1C. Since the discharge tray 12 interferes with the document reader 30 arranged above upon being opened, the document reader 30 set in the closing posture S1 is displaced to the opening posture S2 before opening the discharge tray 12.

The document reader 30 has a rear bottom part thereof supported rotatably about a transversely extending supporting shaft 34 provided at an upper part of the coupling portion 11. The document reader 30 is displaced to the opening posture S2 as shown in FIG. 1C by rotating in counterclockwise direction about the supporting shaft 34 while being set in the closing posture S1 shown in FIG. 1B. Accordingly, upon the replacement of the developing device 25 with a new one, the discharge tray 12 is opened after the document reader 30 is first opened and set to the opening posture S2.

Figure 2A:
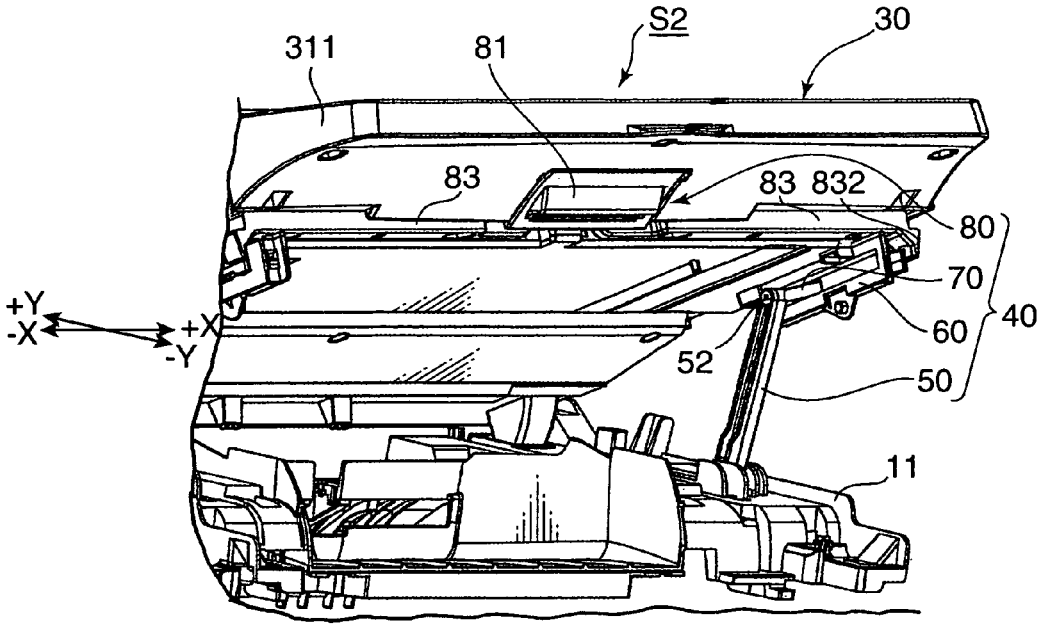
Figure 2B:
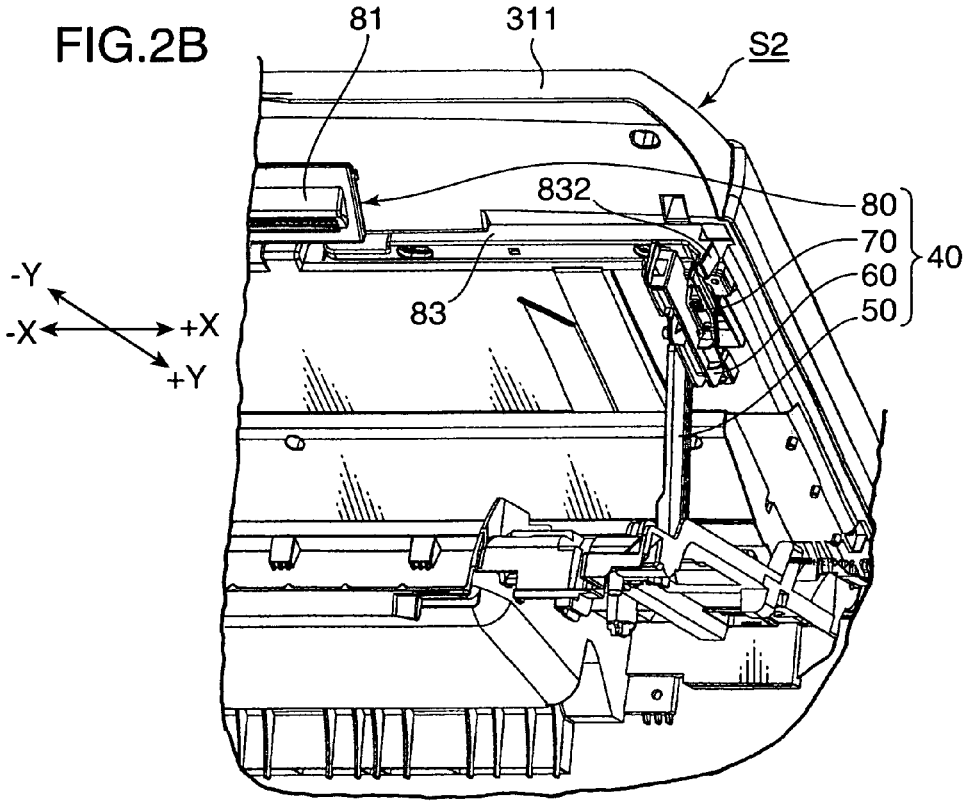
Figure 3B:
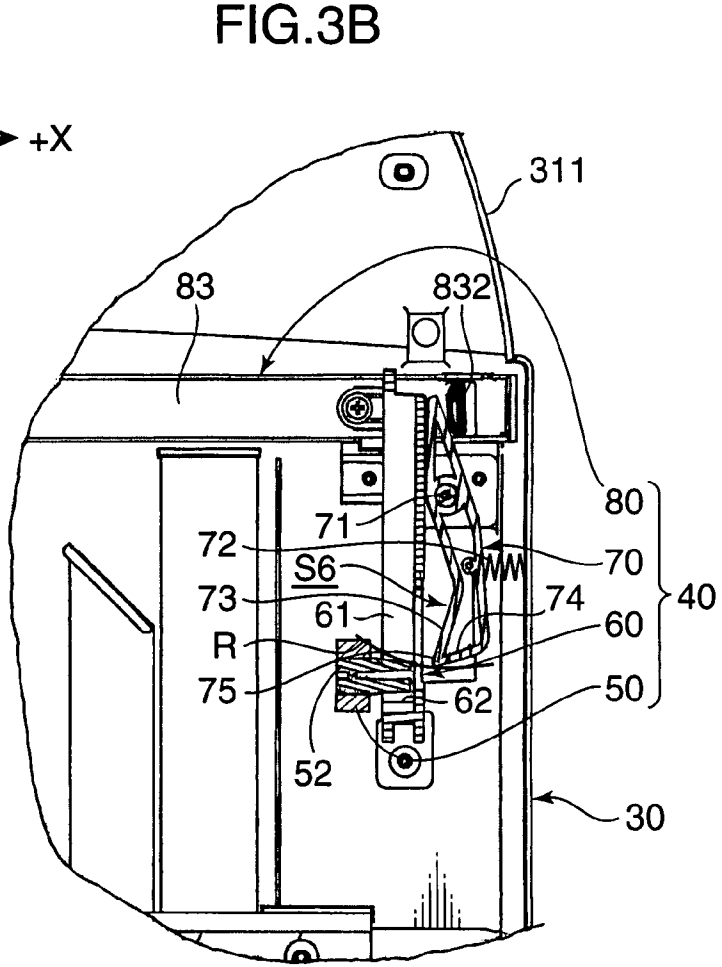
Figure 3A:
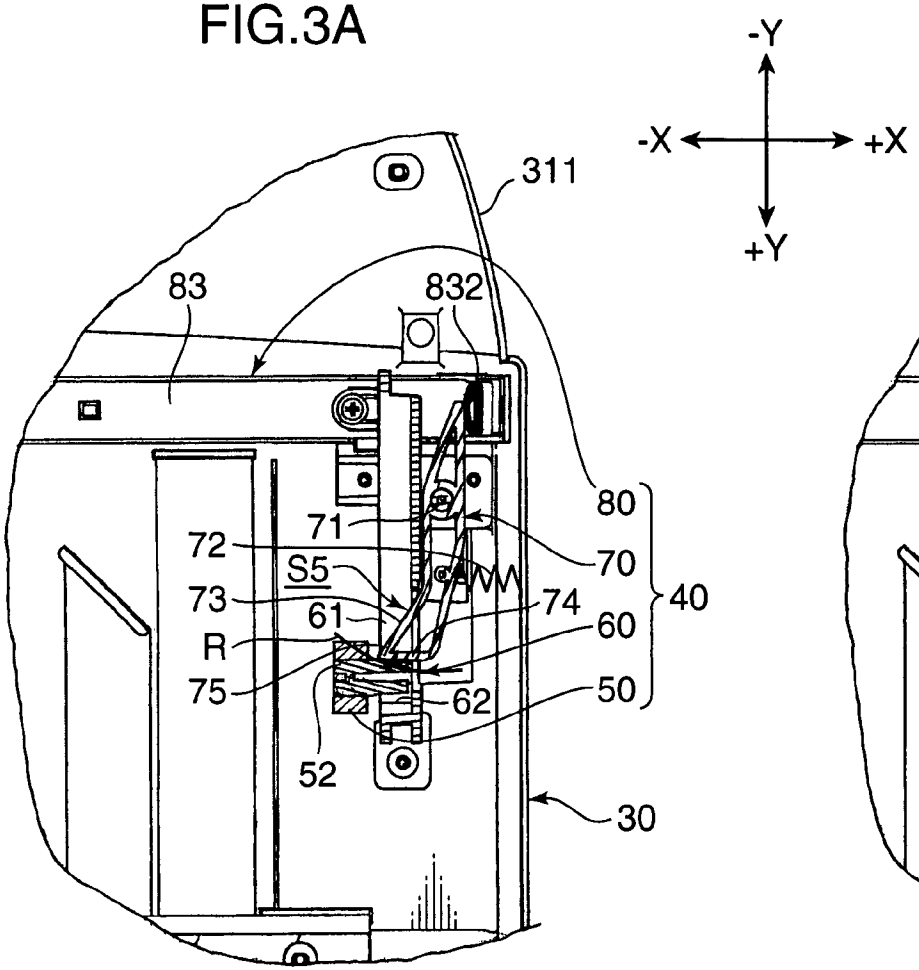

FIGS. 2A and 2B are perspective views showing the opened state of the document reader 30 to describe one embodiment of a locking construction 40 for locking the document reader 30 in the opening posture S2, wherein FIG. 2A shows the state when the opened document reader 30 is viewed from front left side and FIG. 2B shows the state where the opened document reader 30 is viewed from front right side. FIGS. 3A and 3B are diagrams showing the locking construction 40 of FIGS. 2A and 2B when viewed from below the document reader 30, wherein FIG. 3A shows a state where stoppers 70 are set in an interfering posture S5 and FIG. 3B shows a state where the stoppers 70 are set in a freeing posture S6.

Figure 4:
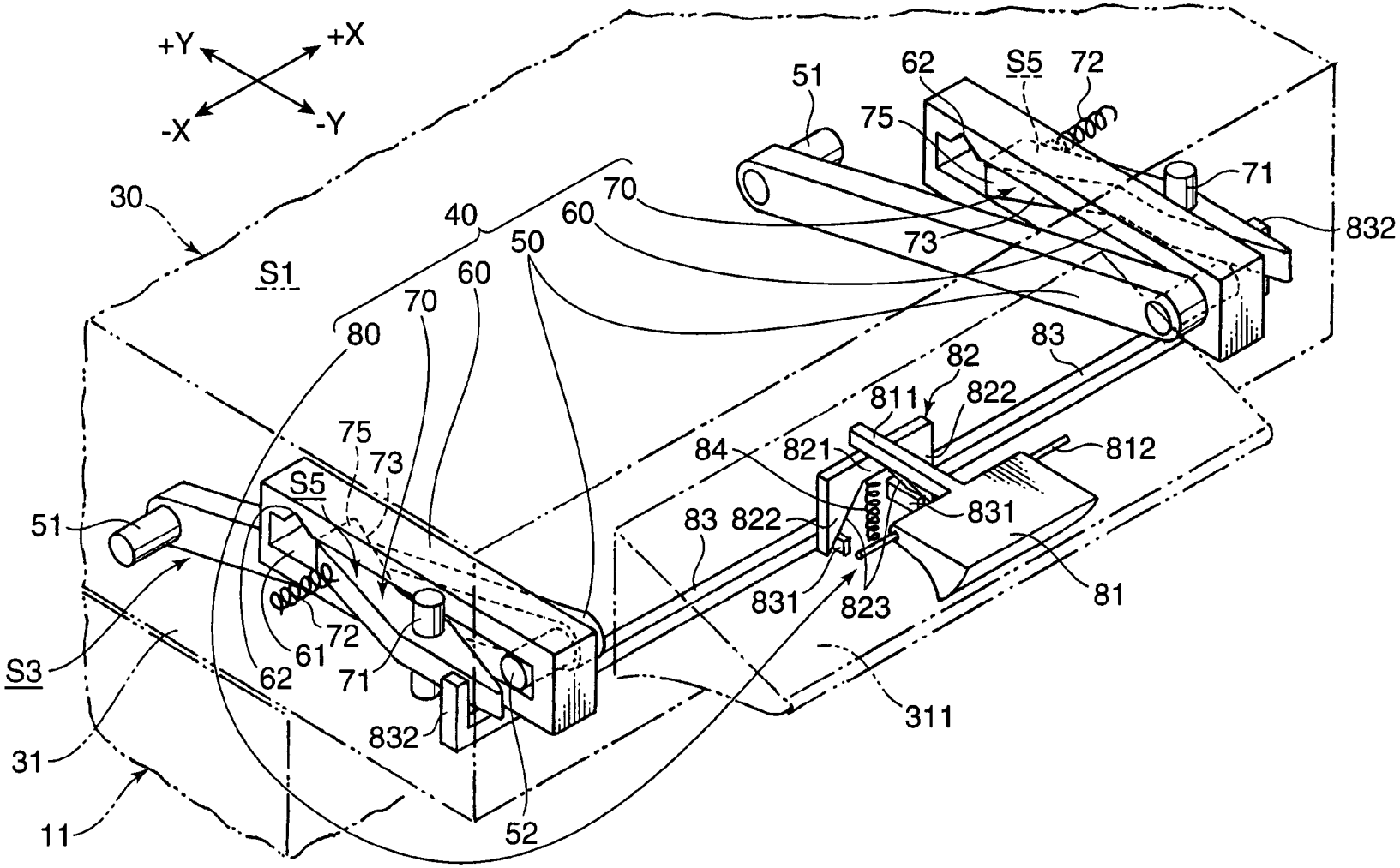
FIG. 4 is a perspective view showing the principle of the locking construction when the document reader is set in the closing posture.
Figure 5:
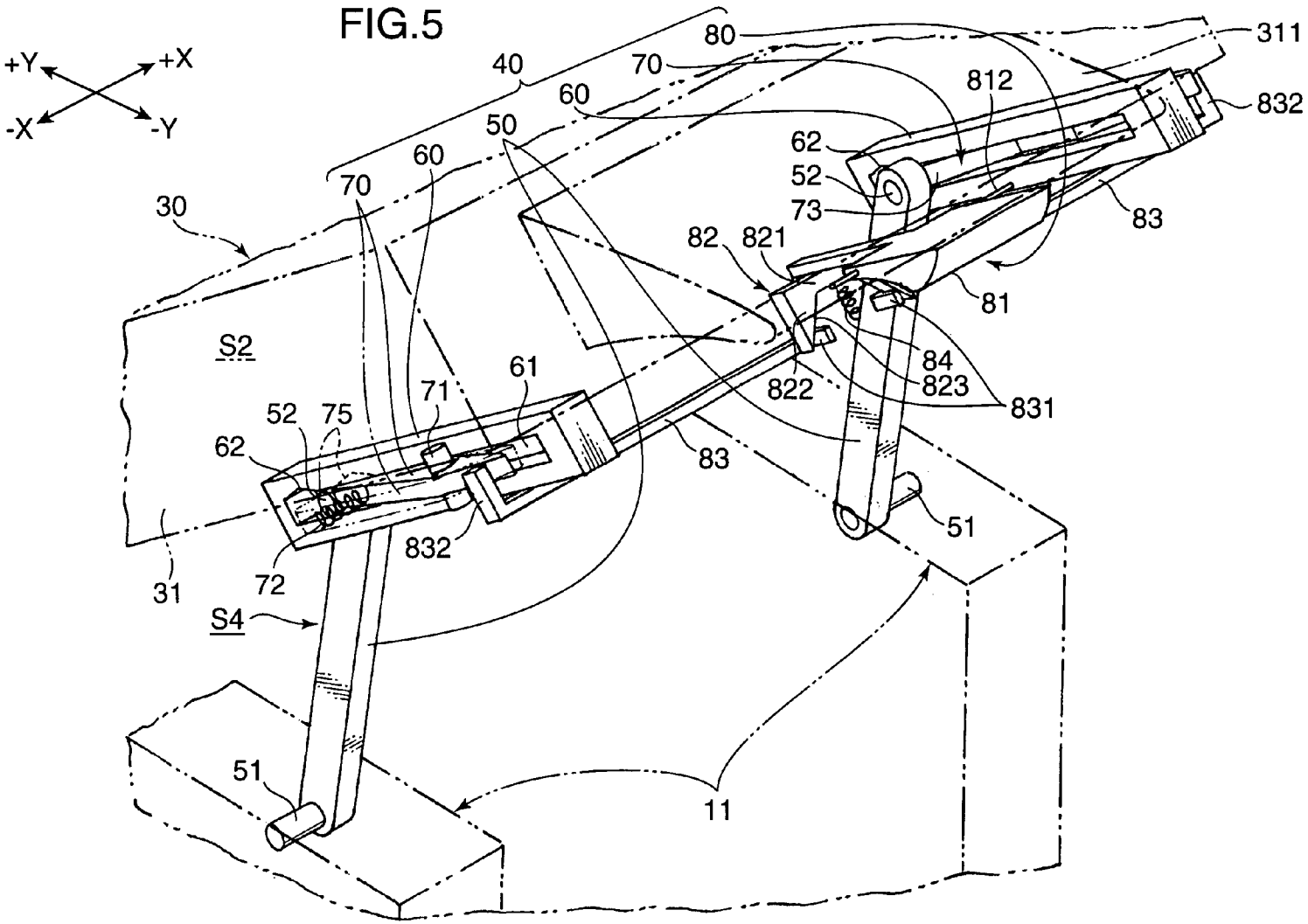
FIG. 5 is a perspective view showing the principle of the locking construction when the document reader is set in the opening posture.

FIGS. 4 and 5 are perspective views showing the principle of the locking construction 40, wherein FIG. 4 shows a state of the locking construction 40 when the document reader 30 is set in the closing posture S1 and FIG. 5 shows a state of the locking construction 40 when the document reader 30 is set in the opening posture S2. It should be noted that directions indicated by X and Y in FIGS. 2A to 5 are similar to the case of FIGS. 1A to 1C (X are transverse directions (−X: leftward direction, +X: rightward direction) and Y are forward and backward directions (−Y: forward direction, +Y: backward direction)).

The locking construction 40 according to the present invention is described below mainly with reference to FIGS. 4 and 5 and also to FIGS. 1A to 3B if necessary. As shown in FIGS. 4 and 5, the locking construction 40 includes a pair of left and right coupling arms 50 disposed between the coupling portion 11 and the document reader 30 and displaceable between a laid posture S3 (second posture) and a standing posture S4 (first posture), guiding members 60 for guiding displacements of these coupling arms 50, the stoppers 70 for locking the document reader 30 in the opening posture S2 by locking the coupling arms 50 in the standing posture S4, and an operating mechanism 80 for operating the stoppers 70.

The length of the coupling arms 50 are set to be slightly shorter than half the length of the document reader 30 excluding the operation table 311 along forward and backward directions. Each coupling arm 50 is a bar-shaped arm having a base end (first end as claimed) and a leading end (second end as claimed) located at the opposite side. Such coupling arms 50 have the base ends (rear sides) thereof supported rotatably about supporting shafts 51 supported at positions slightly before the middle positions of the top part of the coupling portion 11 with respect to forward and backward directions. On the other hand, the leading ends of the coupling arms 50 are movably coupled to the document reader 30. Further, each coupling arm 50 has a projecting shaft 52 projecting outward from the leading end side (front side).

The guiding members 60 are for guiding the projecting shafts 52 of the coupling arms 50 as the document reader 30 is opened and closed and are fixed at left and right positions of the front side of the bottom surface of the document reader 30. Such guiding members 60 are formed with guiding oblong holes 61 extending in forward and backward directions, and the projecting shafts 52 are slidably fitted in these guiding oblong holes 61. Accordingly, as the document reader 30 is opened or closed, the projecting shafts 52 are moved forward or backward in the guiding oblong holes 61, whereby the coupling arms 50 are displaceable between the laid posture S3 (see FIG. 4) and the standing posture S4 (see FIG. 5). It should be noted that an escaping recess 62, in which the projecting shaft 52 (second end) of the coupling arm 50 can be accommodated, is formed in an inner wall (guiding surface) of each guiding oblong hole 61. This escaping recess 62 is described in detail later.

The stoppers 70 are for preventing movements of the projecting shafts 52 in the guiding oblong holes 61 to keep the coupling arms 50 in the standing posture S4 as shown in FIG. 5. The stoppers 70 are arranged at positions proximate to and at the outer sides of the guiding members 60.

Such stoppers 70 has substantially middle parts thereof with respect to forward and backward directions supported rotatably about vertical shafts 71 (specified shafts) provided in the document reader 30. Rear parts of the stoppers 70 are fitted into the guiding oblong holes 61 to be located on the rotational paths of the coupling arms 50. This enables the stoppers 70 to be displaced between the interfering posture S5 (see FIGS. 3A and 4) to interfere with the projecting shafts 52 and the freeing posture S6 (see FIG. 3B) to free the projecting shafts 52 from interference. A first compression spring 72 (biasing member) is mounted at the rear end of each stopper 70, so that the stopper 70 is normally set in the interfering posture S5 as shown in FIG. 4 by a biasing force of the first compression spring 72.

Each stopper 70 has an inclined end surface (inclined surface) 73, a contact surface 74 and a projecting portion 75. The inclined end surfaces 73 are provided at parts of side surfaces of the pair of stoppers 70 facing each other behind the vertical shafts 71 and are so inclined as to shorten spacing toward the back. The contact surface 74 is formed on the rear end surface of each stopper 70, at acute angle to the inclined end surface 73 and adapted to stop the corresponding projecting shaft 52. Each projecting portion 75 is provided at the intersection of the inclined end surface 73 and the contact surface 74 for pressing the projecting shaft 52 of the coupling arm 50 set in the standing posture S4 toward the escaping recess 62 by the outward rotation of the stopper 70 about the vertical shaft 71. FIGS. 3A and 3B show a moving path R of the projecting portion 75 when the stopper 70 is rotated about the vertical shaft 71.

Accordingly, when being moved backward in the guiding oblong holes 61 of the guiding members 60 as the document reader 30 is displaced from the closing posture S1 (see FIG. 4) to the opening posture S2 (see FIG. 5), the projecting shafts 52 of the coupling arms 50 press the inclined end surfaces 73 to rotate the stoppers 70 about the vertical shafts 71 against the biasing forces of the first compression springs 72. Thus, the stoppers 70 are set in the freeing posture S6 (shown in chain double-dashed line in FIG. 5) in which the projecting portions 75 temporarily come out of the guiding oblong holes 61.

The projecting shafts 52 further press the inclined end surfaces 73 to further rotate the stoppers 70 about the vertical shafts 71 by continuously opening the document reader 30. When the projecting shafts 52 pass the inclined end surfaces 73, the respective stoppers 70 are rotated about the vertical shafts 71 in directions to bring the respective projecting portions 75 closer to each other by the biasing forces of the first compression springs 72. In this way, the respective projecting portions 75 are returned to the interfering posture S5 to be fitted into the guiding oblong holes 61 again as shown in solid line in FIG. 3A or in dotted line in FIG. 5.

When the stoppers 70 are set in the interfering posture S5 with the document reader 30 set in the opening posture S2, the projecting shafts 52 interfere with the contact surfaces 74 of the stoppers 70 as shown in FIGS. 3A and 5. Accordingly, the projecting shafts 52 cannot move forward in the guiding oblong holes 61, wherefore the document reader 30 can be locked in the opening posture S2.

The operating mechanism 80 is for freeing the document reader 30 from the locked-state in the opening posture S2 through a specified operation. The operating mechanism 80 includes an operating lever 81 disposed on a lower surface of the operation table 311 of the document reader 30, an elevating member 82 movable upward and downward through the operation of the operating lever 81, and interposed rods 83 movable back and forth along transverse direction as the elevating member 82 is moved upward and downward and interposed between the elevating member 82 and the stoppers 70.

The operating lever 81 includes an operating rod 811 projecting backward from the rear edge thereof. A transversely extending operating shaft 812 provided in the operation table 311 penetrates a rear part of the operating lever 81. A rear end of the operating rod 811 is moved upward and downward by rotating the operating lever 81 about the operating shaft 812.

The leading end (rear end) of the operating rod 811 comes into contact with an upper surface of the elevating member 82. The elevating member 82 has an inverted U-shape and has a transversely extending upper lever 821 and a pair of left and right triangular pieces 822 extending down from left and right portions of the upper lever 821. The end surfaces of the respective triangular pieces 822 facing each other are formed into inclined end surfaces 823 that are so set as to shorten spacing therebetween toward the top. Such an elevating member 82 is biased upward by a second compression spring 84 disposed at a position right below the upper lever 821.

Accordingly, a user presses the operating lever 81 upward by hand (specifically grips the operation table 311 and the operating lever 81 by hand), whereby the operating rod 811 is rotated in counterclockwise direction about the operating shaft 812. By a downward movement of the leading end (rear end) of the operating rod 811 by this rotation, the elevating member 82 is moved downward against a biasing force of the second compression spring 84.

Each interposed rod 83 has an inner engaging projection 831 projecting forward from a transversely inner end thereof, and an outer engaging projection 832 projecting upward from a transversely outer end thereof. For the sake of graphic representation, the outer engaging projections 832 project upward from the interposed rods 83 in FIGS. 4 and 5 while projecting downward from the interposed rods 83 in the example shown in FIGS. 2A, 2B, 3A and 3B.

The length of such interposed rods 83 is set such that the inner engaging projections 831 are in contact with the inclined end surfaces 823 of the elevating member 82 and the outer engaging projections 832 are in contact with the outer side surface of the front end of the stoppers 70. Although the document reader 30 is provided with a guiding mechanism for movably supporting the elevating member 82 and the interposed rods 83, such a guiding mechanism is not shown in FIGS. 4 and 5.

On the other hand, unillustrated locking holes are formed in the respective left and right inner surfaces of the upper external cover body 31 of the document reader 30 at positions corresponding to the respective outer engaging projections 832. With the document reader 30 set in the closing posture S1 (see FIG. 4), the respective outer engaging projections 832 are fitted into and engaged by the corresponding locking holes, thereby preventing the document reader 30 from being not normally opened. When the operating lever 81 is rotated in counterclockwise direction about the operating shaft 812, the respective outer engaging projections 832 come out of the corresponding locking holes by the resulting movements of the respective interposed rods 83 in directions toward each other. By this operation, the document reader 30 moves from the closing posture S1 to the opening posture S2.

According to the operating mechanism 80 thus constructed, if the operation table 311 and the operating lever 81 are gripped by hand and the operating lever 81 is pushed upward, the operating rod 811 is rotated in counterclockwise direction about the operating shaft 812, whereby the elevating member 82 is pressed by the leading end (rear end) of the operating rod 811 to move downward against the biasing force of the second compression spring 84.

When the elevating member 82 moves downward, the inner engaging projections 831 of the respective interposed rods 83 held in contact with the inclined end surfaces 823 formed on the respective triangular pieces 822 move in directions toward each other by being guided by the corresponding inclined end surfaces 823. As the inner engaging projections 831 move, the outer engaging projections 832 pull the front ends of the stoppers 70 inward. By the rotations of the respective stoppers 70 about the vertical shafts 71 resulting from these pulling movements, the rear ends of the stoppers 70 come out of the guiding oblong holes 61 of the guiding members 60 and the stoppers 70 are displaced from the interfering posture S5 (see FIG. 3A) to the freeing posture S6 (see FIG. 3B).

With the document reader 30 set in the closing posture S1 (see FIG. 4), the stoppers 70 are displaced from the interfering posture S5 to the freeing posture S6 and, simultaneously, the respective outer engaging projections 832 come out of the locking holes to enable the document reader 30 to be opened by gripping the operating lever 81 and the operation table 311 by fingers and rotating the operating lever 81 in counterclockwise direction about the operating shaft 812. Thus, the user opens the document reader 30 while gripping the operation table 311 and the operating lever 81, whereby the projecting shafts 52 pass the projecting portions 75 of the stoppers 70 to set the document reader 30 in the opening posture S2. If the gripped state of the operation table 311 and the operating lever 81 is canceled (i.e. the user's grip is loosened), the stoppers 70 return to the initial interfering posture S5 by the biasing forces of the first compressing springs 72 and, thus, the projecting shafts 52 interfere with the projecting portions 75 of the stoppers 70 in the interfering posture S5. In this way, the document reader 30 can be held in the opening posture S2 as shown in FIG. 5.

In this embodiment, the stoppers 70 are formed with the inclined end surfaces 73 and the projecting shaft 52 of the coupling arms 50 come into sliding contact with these inclined end surfaces 73 to rotate the stoppers 70 in directions to bring the respective inclined end surfaces 73 away from each other upon opening the document reader 30 as described above. Thus, once the outer engaging projections 832 come out of the locking holes of the document reader 30 by operating the operating lever 81, the document reader 30 can be displaced from the closing posture S1 to the opening posture S2 even if the user's hold of the operating lever 81 is released and the document reader 30 is opened only by gripping the operation table 311.

If the operating lever 81 is pressed toward the operation table 311 with the document reader 30 set in the opening posture S2 as shown in FIG. 5, the projecting portions 75 of the stoppers 70 come out of the guiding oblong holes 61 of the guiding members 60. Thus, the projecting shafts 52 of the coupling arms 50 become movable in the guiding oblong holes 61, wherefore the document reader 30 can be displaced from the opening posture S2 to the closing posture S1.

In this embodiment, such a construction (posture change facilitating construction) for enabling the document reader 30 to be easily displaceable to the closing posture S1 with the document reader 30 set in the opening posture S2 is adopted for the guiding members 60.

Figure 6:
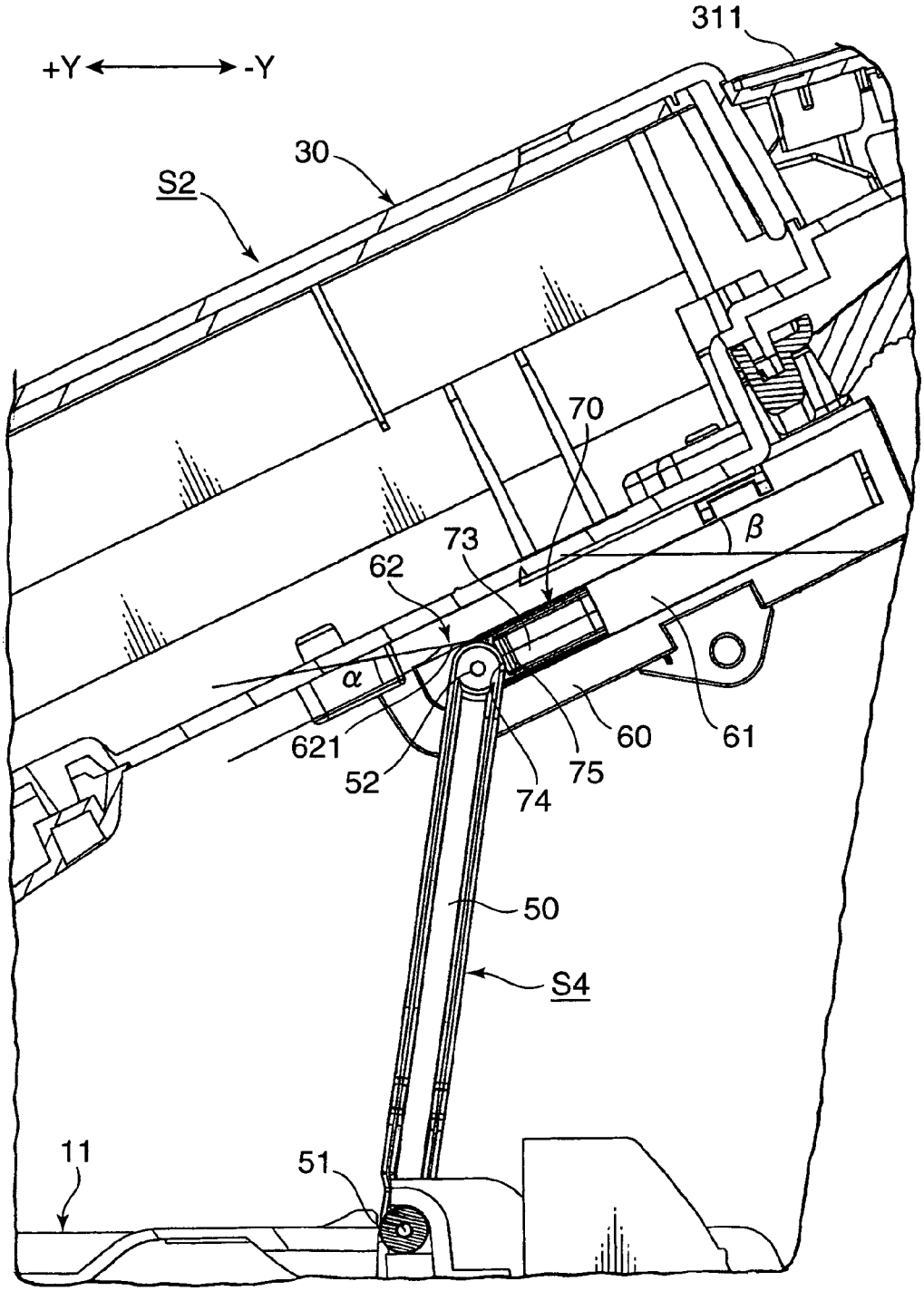
FIG. 6 is a side view of a guiding member.
Figures 7A, 7B, 7C:
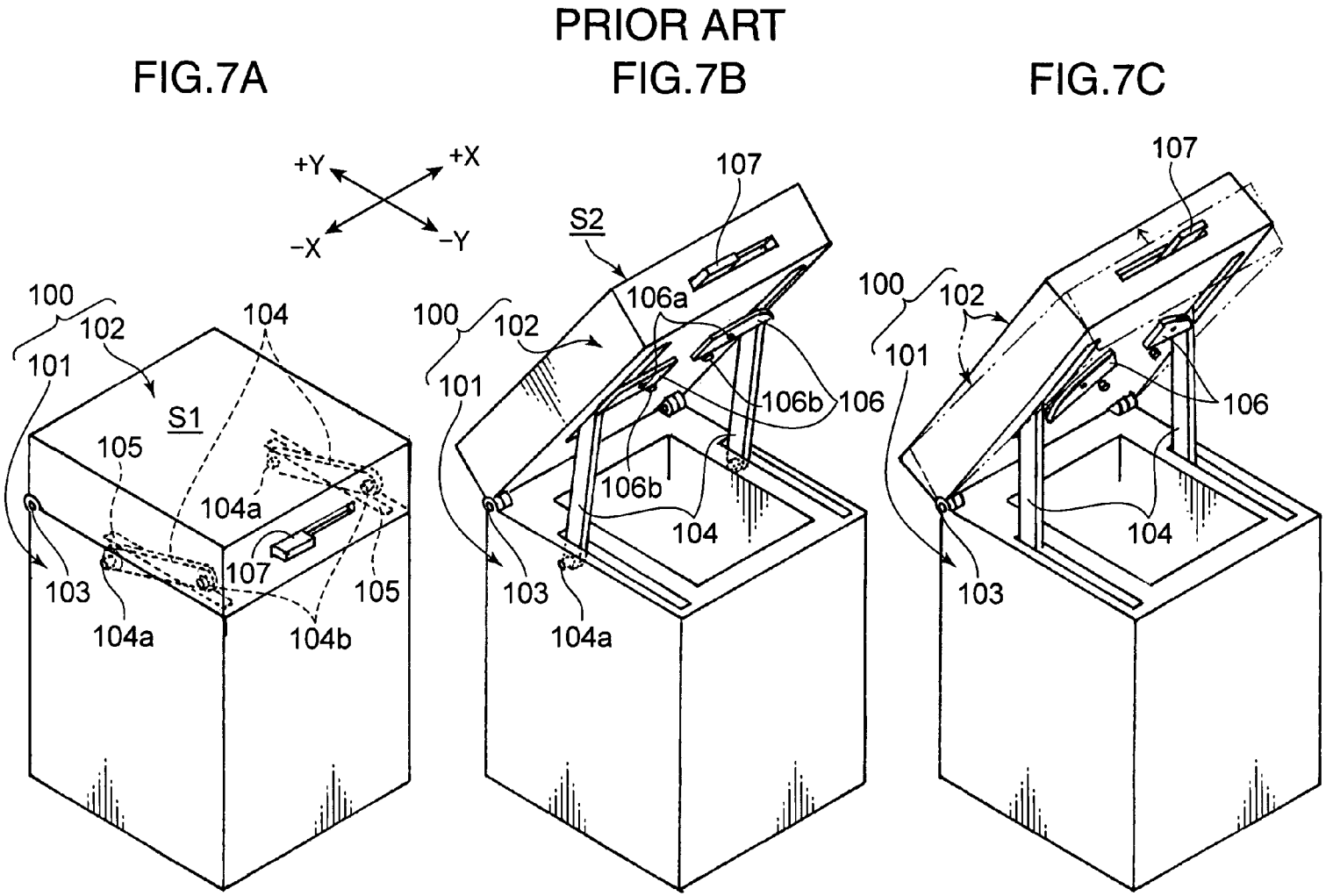
FIG.7A PRIOR ART

FIG. 6 is a side view of the guiding member 60 showing one example of the posture change facilitating construction according to the embodiment of the present invention. It should be noted that directions indicated by Y in FIG. 6 are similar to the case of FIGS. 1A to 1C (−Y: forward direction, +Y: backward direction). In FIG. 6, the document reader 30 is set in the opening posture S2.

With the document reader 30 set in the opening posture S2, the coupling arms 50 are set in the standing posture S4 to be inclined slightly forward from the upright posture. Accordingly, the coupling arms 50 in such a state try to rotate in clockwise direction about the supporting shafts 51 by the action of the weight of the document reader 30. However, since the projecting portions 75 and the contact surfaces 74 of the stoppers 70 are located in the guiding oblong holes 61 of the guiding members 60, the projecting shafts 52 of the coupling arms 50 interfere with these projecting portions 75 and contact surfaces 74 of the stoppers 70. By this interference, the clockwise rotations of the coupling arms 50 about the supporting shafts 51 are hindered, i.e. the coupling arms 50 are locked.

In order to cancel this locked state, the operating lever 81 is pressed as described in detail above. By this pressing operation, the stoppers 70 are rotated in counterclockwise direction in FIGS. 3A and 3B about the vertical shafts 71, thereby being displaced from the interfering posture S5 shown in FIG. 3A to the freeing posture S6 shown in FIG. 3B. The projecting portions 75 of the stoppers 70 push the projecting shafts 52 backward by this displacement, wherefore the coupling arms 50 slightly rotate in counterclockwise direction in FIG. 6 about the supporting shafts 51. By this rotation, the projecting shafts 52 have to lift the document reader 30 via the upper edges of the guiding oblong holes 61. However, since the document reader 30 is heavy, it is quite difficult to lift the document reader 30 only by forces given to the projecting shafts 52 through the operation of the operating lever 81. In order to carry out this rotation, the operating lever 81 has to be operated by one hand at the same time the document reader 30 is lifted by the other hand. This is very cumbersome.

Accordingly, in this embodiment, the escaping recess 62 having an inverted V-shape is formed at the upper edge portion of each guiding oblong hole 61 at a position behind the rear end (i.e. contact surface 74 of the stopper 70 fitted in the guiding oblong hole 61) of the stopper 70 set in the interfering posture S5. An angle of inclination $\alpha$ of a front inclined surface 621 at the front side of this escaping recess 62 with respect to an extending direction of the guiding oblong hole 61 (guiding surface) is set such that the front inclined surface 621 extends substantially along a rotational path of the projecting shaft 52 at the upper end of the coupling arm 50.

Upon displacing the stoppers 70 from the interfering posture S5 to the freeing posture S6 against the biasing force of the first compression spring 72 by operating the operating lever 81, the stoppers 70 rotate about the vertical shafts 71 and the projecting portions 75 move along the moving paths R as shown in FIGS. 3A and 3B. By providing the above escaping recesses 62, the projecting shafts 52 are fitted into the escaping recesses 62 when the projecting portions 75 and the contact surfaces 74 move along the moving paths R to push the projecting shafts 52 of the coupling arms 50. In other words, the projecting shafts 52 are let to escape to such positions as not to interfere with the moving paths R of the projecting portions 75 by a relatively small force given through the operation of the operating lever 81 (see FIG. 3B). Thus, an amount of lifting the document reader 30 can be maximally reduced.

Accordingly, the user can easily displace the stoppers 70 from the interfering posture S5 to the freeing position S6 by pressing the operating lever 81 only by one hand without performing a cumbersome operation of operating the operating lever 81 by one hand while lifting the document reader 30 by the other hand. In its turn, the document reader 30 can be easily displaced from the opening posture S2 to the closing posture S1.

In this embodiment, the angle of inclination $\alpha$ of the front inclined surfaces 621 of the escaping recesses 62 with respect to the guiding oblong holes 61 is set smaller than an angle of inclination $\beta$ of the document reader 30 set in the opening posture S2 with respect to a horizontal plane. This can prevent an occurrence of such inconvenience that the coupling arms 50 bearing the weight of the document reader 30 rotate in counterclockwise direction about the supporting shafts 51 to fit the projecting shafts 52 into the escaping recesses 62 without being pushed by the contact surfaces 74 of the stoppers 70.

As described in detail above, the image forming apparatus 10 according to this embodiment is provided with the document reader 30 displaceable between the closing posture S1 and the opening posture S2 by rotating about the supporting shaft 34 relative to the upper surface of the apparatus main body 20 for image formation, the coupling arms 50 rotatable about the supporting shafts 51 disposed at the upper parts of the apparatus main body 20 to displace between the standing posture S4 and the laid posture S3 and adapted to support the document reader 30 while being set in the standing posture S4, and the stoppers 70 for preventing the displacements of the coupling arms 50 from the standing posture S4 to the laid posture S3.

The stoppers 70 are supported rotatably about the vertical shafts 71 so as to be displaceable between the interfering posture S5 to interfere with the rotational paths of the coupling arms 50 about the supporting shafts 51 and the freeing posture S6 to free the coupling arms 50 from interference, and are constructed to return to the rotational paths of the coupling arms 50 after temporarily moving the coupling arms 50 toward the standing posture S4 by a specified amount of rotation thereof.

According to the image forming apparatus 10 thus constructed, the coupling arms 50 set in the laid posture S3 rotate in a specified direction about the supporting shafts 51 toward the standing posture S4 by rotating the document reader 30 about the supporting shaft 34 to displace it toward the opening posture S2 with the document reader 30 set in the closing posture S1 to close the upper surface of the apparatus main body 20.

The coupling arms 50 rotating toward the standing posture S4 pass the stoppers 70 interfering with the rotational paths of the coupling arms 50 and then have their displacements toward the laid posture S3 hindered by the return of the stoppers 70 to the rotational paths. Therefore, the document reader 30 can be securely held in the opening posture S2 by being supported by the coupling arms 50.

The escaping recesses 62 extending substantially along the rotational paths of the upper ends of the coupling arms 50 are provided at the rear positions of the upper edge portions of the guiding oblong holes 61 of the guiding members 60 provided in the document reader 30. Thus, upon returning the document reader 30 once set in the opening posture S2 to the initial closing posture S1, the stoppers 70 can be displaced from the interfering posture S5 to the freeing posture S6 even without lifting the document reader 30 by a particularly considerable amount. This eliminates the need for temporarily lifting the heavy document reader 30 by one hand as with the prior art apparatus and, accordingly, operability in closing the document reader 30 can be improved without increasing the number of parts.

Further, the angles of the front inclined surfaces 621 of the escaping recesses 62 with respect to the bottom surface of the document reader 30 are set smaller than the angle of inclination of the document reader 30 set in the opening posture S2 with respect to the horizontal plane. This can prevent an occurrence of such inconvenience that the coupling arms 50 bearing the weight of the document reader 30 rotate in counterclockwise direction about the supporting shafts 51 to fit the projecting shafts 52 into the escaping recesses 62 without being pushed by the contact surfaces 74 of the stoppers 70.

Furthermore, since the operating lever 81 constructed to enable the stoppers 70 to rotate about the vertical shafts 71 is provided, the operation of returning the document reader 30 set in the opening posture S2 to the initial closing posture S1 by rotating the stoppers 70 about the vertical shafts 71 can be easily performed by operating the operating lever 81.

The present invention is not limited to the foregoing embodiment and also embraces the following contents.

(1) Although a copier is taken as an example of the image forming apparatus 10 in the foregoing embodiment, the image forming apparatus 10 is not limited to the copier and may be a facsimile machine, a printer or the like according to the present invention.

(2) In the foregoing embodiment, the operating mechanism 80 including the operating lever 81, the elevating member 82, and the interposed rods 83 is taken as an example. In place of such an operating mechanism 80, for example, the modified operating mechanism may be adopted that has no operating lever and no elevating member, and has inner engaging projections 831 on a pair of interposed rods 83 which are projected outward from the operation table 311. The stoppers 70 are displaced by gripping the inner engaging projections 831 by fingers to move them toward each other. Alternatively, the stoppers 70 may be displaced using various kinds of link mechanisms.

(3) In the foregoing embodiment, the angle of inclination $\alpha$ of the front inclined surfaces 621 of the escaping recesses 62 is set smaller than the angle of inclination $\beta$ of the document reader 30 set in the opening posture S2. However, it is sufficient to set the angle of inclination $\alpha$ of the front inclined surfaces 621 smaller than an angle of tangents to the rotational paths of the projecting shafts 52 of the coupling arms 50 with respect to the rotational paths even if this angle of inclination $\alpha$ is larger than the angle of inclination $\beta$ of the document reader 30. In this case as well, the same functions and effects as the foregoing embodiment can be obtained.

(4) In the foregoing embodiment, the coupling arms 50 are displaceable between the standing posture S4 (first posture) and the laid posture S3 (second posture). However, the second posture may not be necessarily the laid state and may be sufficient to be closer to a horizontal posture than the first posture.

(5) In the foregoing embodiment, the document reader 30 is rotatably mounted relative to the apparatus main body 20 of the image forming apparatus 10. The present invention is not limited thereto, and is applicable to any apparatus in general that is a composite apparatus formed by combining a first apparatus and a second apparatus displaceable between a closing posture and an opening posture by rotating about a specified supporting shaft relative to the upper surface of the first apparatus. For example, the present invention is also applicable to various household apparatuses, industrial apparatuses and testing apparatuses.

The aforementioned specific embodiments mainly embrace features of the inventions having the following constructions.

An image forming apparatus according to one aspect of the present invention comprises an apparatus main body for performing an image forming operation; a document reader displaceable between a closing posture and an opening posture by rotating about a specified supporting shaft relative to the upper surface of the apparatus main body; a coupling arm having a first end and a second end located at a side opposite to the first end, the first end being rotatably coupled to the apparatus main body and the second end being movably coupled to the document reader, and displaceable between a first posture to support the document reader in the opening posture in a standing state and a second posture taken when the document reader is in the closing posture and closer to a horizontal posture than the standing posture; a guiding member provided at the document reader and having a guiding surface for guiding a movement of the second end of the coupling arm; and a stopper supported rotatably about a specified shaft so as to be displaceable between an interfering posture to interfere with the second end of the coupling arm and a freeing posture to free the second end from interference, wherein an escaping recess capable of accommodating the second end therein is formed in the guiding surface of the guiding member, and the second end is guided into the escaping recess by a pushing force given from the stopper to the second end when the stopper is displaced from the interfering posture to the freeing posture.

With such a construction, by rotating the document reader about the supporting shaft to displace it toward the opening posture with the document reader set in the closing position to close the upper surface of the apparatus main body, the coupling arm set in the second posture moves toward the first posture by the first end rotating in a specified direction about the supporting shaft while the second end is guided by the guiding member. The coupling arm rotating toward the first posture has its displacement toward the second posture hindered by the stopper by the return of the stopper from the freeing posture to the interfering posture after the second end passes the stopper. Therefore, the document reader can be securely held in the opening posture by being supported by the coupling arm.

The escaping recess capable of accommodating the second end of the coupling arm therein is formed in the guiding surface of the guiding member. The second end of the coupling arm is guided into the escaping recess by the pushing force given from the stopper to the coupling arm when the stopper is displaced from the interfering posture to the freeing posture. Thus, upon returning the document reader once set in the opening posture to the initial closing posture, the stopper can be displaced from the interfering posture to the freeing posture by letting the second end of the coupling arm to enter the escaping recess even without lifting the document reader by a particularly considerable amount. This eliminates the need for temporarily lifting the heavy document reader by one hand as with the prior art image forming apparatus, thereby improving operability in closing the document reader without increasing the number of parts.

In the above construction, it is preferable that a biasing member is further provided to bias the stopper toward the interfering posture; that the stopper has an inclined surface for moving the stopper toward the freeing posture while being held in sliding contact with the second end upon moving the coupling arm from the second posture to the first posture, a contact surface with which the second end comes into contact to be stopped after the second end passes the inclined surface and the stopper is displaced to the interfering posture, and a projecting portion provided between the inclined surface and the contact surface; and that a pushing force is given from the projecting portion to the second end when the stopper is displaced from the interfering posture to the freeing posture against a biasing force of the biasing member.

With such a construction, in the process of displacing the coupling arm from the second posture to the first posture, the second end comes into sliding contact with the inclined surface of the stopper, thereby rotating the stopper from the interfering posture to the freeing posture about a specified shaft against the biasing force of the biasing member. When the second end passes the inclined surface of the stopper, the stopper is returned from the freeing posture to the interfering posture by the biasing force of the biasing member. As a result, the coupling arm is set in the first posture with the second end held in contact with the contact surface of the stopper, wherefore the document reader can be kept in the opening posture while being stably supported on the coupling arm in the first posture.

Upon returning the document reader once set in the opening posture to the initial closing posture, the stopper may be rotated about the specified shaft from the interfering posture to the freeing posture against the biasing force of the biasing member. By doing so, the stopper is displaced to the freeing posture deviating from the rotational path of the coupling arm after the projecting portion of the stopper temporarily pushes the second end of the coupling arm in a direction away from the second posture. The second end of the coupling arm is freed from the locked state by the stopper, whereby the document reader is displaced from the opening posture to the closing posture by the rotation of the coupling arm about the supporting shaft from the first posture to the second posture.

By using such a stopper, the document reader can be easily opened and closed in cooperation with the escaping recess while the construction for locking and unlocking the coupling arm in and from the standing posture is simplified.

In the above construction, it is preferable that the escaping recess has an inclined guiding surface for guiding the second end thereinto and that an angle of the inclined guiding surface with respect to the guiding surface is set smaller than an angle of inclination of the document reader set in the opening posture with respect to a horizontal plane.

With such a construction, there is no likelihood of the second end of the coupling arm entering the escaping recess with the coupling arm set in the first posture and the displacement thereof to the freeing posture hindered by the stopper set in the interfering posture. If the angle of inclination of the escaping recess should be larger, the upper end of the coupling arm enters the escaping recess to lower the document reader just by this much, making it necessary to temporarily lift the document reader upon closing the document reader. An occurrence of such inconvenience can be avoided by this construction.

In the above construction, it is preferable to further provide an operating lever for rotating the stopper about the specified shaft.

With such a construction, the operation of returning the document reader set in the opening posture through the rotation of the stopper about the specified shaft to the initial closing posture can be easily performed by operating the operating lever.

In the above construction, it is preferable that a unit member interchangeably mountable into the apparatus main body and a discharge tray to which a sheet after the image forming operation is discharged are further provided, that the document reader is arranged above the apparatus main body while defining a space therebetween, that the discharge tray is provided at the upper surface of the apparatus main body and is partially or entirely openable and closable as an opening cover for the interchange of the unit member, and that the opening cover can open and close without interfering with the document reader when the document reader is in the opening posture.

A composite apparatus according to another aspect of the present invention comprises a first apparatus; a second apparatus displaceable between a closing posture and an opening posture by rotating about a specified supporting shaft relative to the upper surface of the first apparatus; a coupling arm having a first end and a second end located at a side opposite to the first end, the first end being rotatably coupled to the first apparatus and the second end being movably coupled to the second apparatus, and displaceable between a first posture to support the second apparatus in the opening posture in a standing state and a second posture taken when the second apparatus is in the closing posture and closer to a horizontal posture than the standing posture; a guiding member provided at the second apparatus and having a guiding surface for guiding a movement of the second end of the coupling arm; and a stopper supported rotatably about a specified shaft so as to be displaceable between an interfering posture to interfere with the second end of the coupling arm and a freeing posture to free the second end from interference, wherein an escaping recess capable of accommodating the second end therein is formed in the guiding surface of the guiding member, and the second end is guided into the escaping recess by a pushing force given from the stopper to the second end when the stopper is displaced from the interfering posture to the freeing posture.

This application is based on patent application No. 2006-019759 filed in Japan, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body for performing an image forming operation;

a document reader displaceable between a closing posture and an opening posture by rotating about a specified supporting shaft relative to an upper surface of the apparatus main body;

a coupling arm having a first end and a second end located at a side opposite to the first end, the first end being rotatably coupled to the apparatus main body and the second end being movably coupled to the document reader, and displaceable between a first posture to support the document reader in the opening posture in a standing state and a second posture taken when the document reader is in the closing posture and closer to a horizontal posture than the standing posture;

a guiding member provided at the document reader and having a guiding surface for guiding a movement of the second end of the coupling arm; and a stopper supported rotatably about a specified shaft so as to be displaceable between an interfering posture to interfere with the second end of the coupling arm and a freeing posture to free the second end from interference, wherein an escaping recess capable of accommodating the second end therein is formed in the guiding surface of the guiding member, and the second end is guided into the escaping recess by a pushing force given from the stopper to the second end when the stopper is displaced from the interfering posture to the freeing posture.

2. An image forming apparatus according to claim 1, further comprising a biasing member for biasing the stopper toward the interfering posture, wherein:

the stopper has an inclined surface for moving the stopper toward the freeing posture while being held in sliding contact with the second end upon moving the coupling arm from the second posture to the first posture, a contact surface with which the second end comes into contact to be stopped after the second end passes the inclined surface and the stopper is displaced to the interfering posture, and a projecting portion provided between the inclined surface and the contact surface; and a pushing force is given from the projecting portion to the second end when the stopper is displaced from the interfering posture to the freeing posture against a biasing force of the biasing member.

3. An image forming apparatus according to claim 1, wherein:

the escaping recess has an inclined guiding surface for guiding the second end thereinto; and an angle of the inclined guiding surface with respect to the guiding surface is set smaller than an angle of inclination of the document reader set in the opening posture with respect to a horizontal plane.

4. An image forming apparatus according to claim 1, further comprising an operating lever for rotating the stopper about the specified shaft.

5. An image forming apparatus according to claim 1, further comprising:

a unit member interchangeably mountable into the apparatus main body; and a discharge tray to which a sheet after the image forming operation is discharged, wherein the document reader is arranged above the apparatus main body while defining a space therebetween;

the discharge tray is provided at the upper surface of the apparatus main body and is partially or entirely openable and closable as an opening cover for interchange of the unit member; and the opening cover can open and close without interfering with the document reader when the document reader is in the opening posture.

6. A composite apparatus, comprising:

a first apparatus;

a second apparatus displaceable between a closing posture and an opening posture by rotating about a specified supporting shaft relative to an upper surface of the first apparatus;

a coupling arm having a first end and a second end located at a side opposite to the first end, the first end being rotatably coupled to the first apparatus and the second end being movably coupled to the second apparatus, and displaceable between a first posture to support the second apparatus in the opening posture in a standing state and a second posture taken when the second apparatus is in the closing posture and closer to a horizontal posture than the standing posture;

a guiding member provided at the second apparatus and having a guiding surface for guiding a movement of the second end of the coupling arm; and a stopper supported rotatably about a specified shaft so as to be displaceable between an interfering posture to interfere with the second end of the coupling arm and a freeing posture to free the second end from interference, wherein an escaping recess capable of accommodating the second end therein is formed in the guiding surface of the guiding member, and the second end is guided into the escaping recess by a pushing force given from the stopper to the second end when the stopper is displaced from the interfering posture to the freeing posture.

7. A composite apparatus according to claim 6, further comprising a biasing member for biasing the stopper toward the interfering posture, wherein:

the stopper has an inclined surface for moving the stopper toward the freeing posture while being held in sliding contact with the second end upon moving the coupling arm from the second posture to the first posture, a contact surface with which the second end comes into contact to be stopped after the second end passes the inclined surface and the stopper is displaced to the interfering posture, and a projecting portion provided between the inclined surface and the contact surface; and a pushing force is given from the projecting portion to the second end when the stopper is displaced from the interfering posture to the freeing posture against a biasing force of the biasing member.

8. A composite apparatus according to claim 6, wherein:

the escaping recess has an inclined guiding surface for guiding the second end thereinto; and an angle of the inclined guiding surface with respect to the guiding surface is set smaller than an angle of inclination of the second apparatus set in the opening posture with respect to a horizontal plane.

9. A composite apparatus according to claim 6, further comprising an operating lever for rotating the stopper about the specified shaft.

* * * * *